US006445356B1

(12) United States Patent
Yuanzhu

(10) Patent No.: US 6,445,356 B1
(45) Date of Patent: Sep. 3, 2002

(54) PRIMARY RADIATOR HAVING REDUCED SIDE LOBE

(75) Inventor: Dou Yuanzhu, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/639,521

(22) Filed: Aug. 15, 2000

(30) Foreign Application Priority Data

Sep. 6, 1999 (JP) ..... 11-252232

(51) Int. Cl.[7] ..... H01Q 13/00
(52) U.S. Cl. ..... 343/786; 343/772
(58) Field of Search ..... 343/786, 772, 343/771; 333/21 A, 135; H01Q 13/00

(56) References Cited

U.S. PATENT DOCUMENTS 3,631,502 A * 12/1971 Leon ..... 343/786
3,680,139 A * 7/1972 Reynolds ..... 343/756
4,380,014 A * 4/1983 Howard ..... 343/786
4,568,943 A * 2/1986 Bowman ..... 343/756
4,622,559 A * 11/1986 Shafai et al. ..... 343/786
4,797,981 A * 1/1989 Kaplan et al. ..... 343/786
5,043,629 A * 8/1991 Doane ..... 333/230
5,200,757 A * 4/1993 Jairam ..... 343/786
5,459,441 A * 10/1995 Weber et al. ..... 343/786
6,005,528 A * 12/1999 Priess et al. ..... 343/786
6,072,437 A * 6/2000 Zimmerman et al. ..... 343/753

FOREIGN PATENT DOCUMENTS

JP 5-267926 10/1993 ..... H01Q/19/12

* cited by examiner

*Primary Examiner*—Tho Phan
(74) *Attorney, Agent, or Firm*—Beyer Weaver & Thomas LLP

(57) ABSTRACT

The primary radiator comprises a circular waveguide having a cone-shaped horn portion at one end and an enclosing surface at the other end, and a first and second probes inserted into the waveguide through a wall thereof. A plurality of cutout portions are formed at an open end of the horn portion. Two or more pairs of cutout portions are disposed symmetrically with respect to an axis of the waveguide and a depth of each cutout portion is adjusted to be about one quarter of the wavelength of the radio wave λ0 transmitted through the air. With such a configuration, the phase reversal of surface currents flowing through the cutout portions and an adjacent projecting portion (a portion without cutout portions) take place, and a side lobe of a radiation pattern can be reduced considerably.

20 Claims, 2 Drawing Sheets

PRIMARY RADIATOR HAVING REDUCED SIDE LOBE

BACKGROUND OF THE INVENTION

1. Field of the Invention

The present invention relates to a primary radiator provided to a satellite reflecting antenna, etc. In particular, it relates to a primary radiator having a horn portion for introducing radio waves at one end of a waveguide.

2. Description of the Related Art

FIG. 3 shows a conventional primary radiator of the kind described above. This primary radiator comprises a circular waveguide 1 having a horn portion 1*a* at one end and an enclosing surface 1*b* at the other end, and a first and second probes 2, 3 inserted into the waveguide 1 through a wall thereof. The horn portion 1*a* forms a cone-shaped or pyramid-shaped opening, and the waveguide 1 including this horn portion 1*a* is integrally formed by aluminum die-casting, etc. Further, the two probes 2, 3 form a right angle, and are located one quarter of the guide wavelength away from the enclosing surface 1*a* of the waveguide 1.

In the primary radiator generally configured as described above, linearly polarized waves sent from a satellite are guided into the waveguide 1 by the horn portion 1*a*. Of the linearly polarized waves, for instance, vertically polarized waves are received through the first probe 2 and horizontally polarized waves are received through the second probe 3. Therefore, by frequency-converting received signals from the probes 2, 3 using a converting circuit (not shown) into intermediate frequency signals and outputting them, the linearly polarized waves sent from the satellite can be received.

In the above-described conventional primary radiator, as shown by a dashed line in FIG. 4, it is known that the radiation pattern becomes a shape including a side lobe. This is because the side lobe is produced by a surface current flowing on the surface of the horn portion. For instance, when the design angle of radiation of the horn portion is 90° (±45° with respect to the center), high side lobes are produced at around ±50°. Accordingly, the gain of the main lobe at the center of the angle of radiation is decreased, which brings about the problem of being unable to receive radio waves from the satellite efficiently.

SUMMARY OF THE INVENTION

According to the present invention, at least a pair of cutout portions are provided at an opening end of a horn portion to reduce a side lobe. Provision of such cutout portions causes a phase reversal of surface currents flowing through cutout portions and an adjacent projecting portion and further a considerable reduction of the side lobe, which in turn can increase the gain of a main lobe that much.

The primary radiator of the present invention comprises a waveguide having a horn portion at one end for introducing radio waves and a probe for receiving at least one wave polarization component entering the waveguide, wherein a pair of cutout portions having a depth of about one quarter of the wavelength are provided at an opening end of the horn portion, the pair of cutout portions being disposed symmetrically with respect to an axis of the waveguide.

With such a configuration, the phase reversal of the surface currents flowing through the cutout portions and the adjacent projecting portion takes place and the side lobe is reduced considerably, which in turn can increase the gain of the main lobe to achieve efficient reception of radio waves from a satellite.

In the above configuration, at least a pair of cutout portions may be provided. However, it is preferable to provide two or more pairs of cutout portions along the rim of the horn portion. Further, it is preferable to dispose at least a pair of cutout portions along the direction in which the probe extends.

DESCRIPTION OF THE PREFERRED EMBODIMENTS

Preferred embodiments of the present invention will now be described in conjunction with the accompanying drawings.

Figure 1:
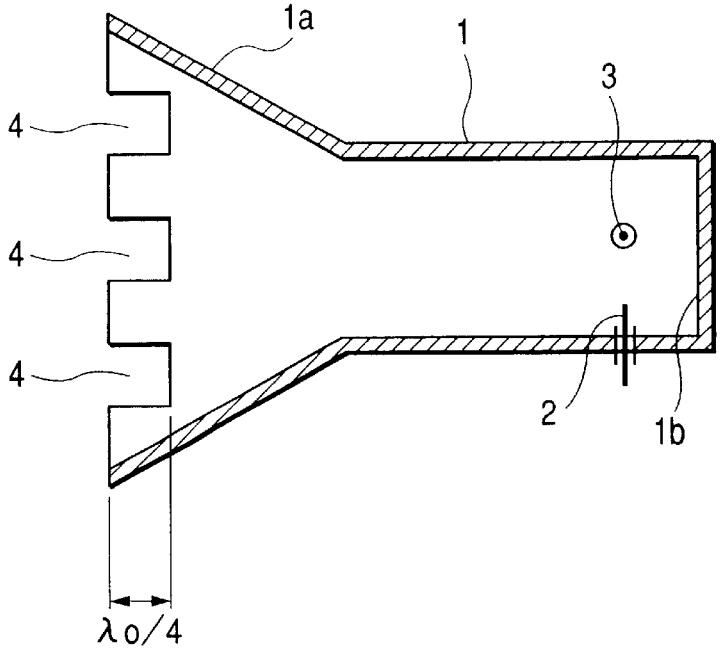
FIG. 1 is a sectional view of a primary radiator according to an embodiment of the present invention.
Figure 2:
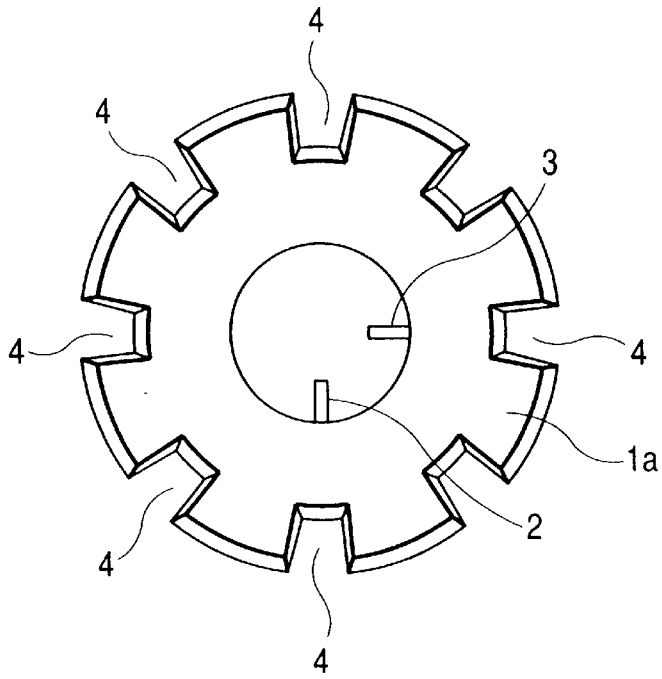
FIG. 2 is a side view of the primary radiator.
Figure 3:
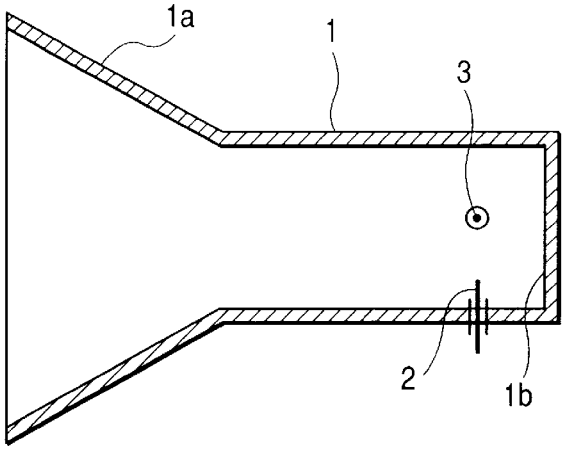
FIG. 3 PRIOR ART
FIG. 3 is a sectional view of a conventional primary radiator.

FIG. 1 is a sectional view of a primary radiator according to an embodiment of the present invention, FIG. 2 is a side view of the primary radiator, and like reference characters refer to corresponding parts in FIG. 3.

The primary radiator of the present embodiment differs from the above described prior art in that a plurality of cutout portions 4 are formed at an opening end of the horn portion 1*a*, and rest of the configuration is basically the same. Namely, this primary radiator comprises a circular waveguide 1 having a cone-shaped horn portion 1*a* at one end and an enclosing surface 1*b* at the other end, and a first and second probes 2, 3 inserted into the waveguide 1 through a wall thereof. The two probes 2, 3 are located at a position about one quarter of the guide wavelength away from the enclosing surface 1*a*. Further, the two probes 2, 3 are so disposed as to form a right angle. Of the linearly polarized waves entering the waveguide 1, vertically polarized wave components are received through the first probe 2, and horizontally polarized wave components are received through the second probe 3.

Two or more pairs of cutout portions 4 are disposed symmetrically with respect to an axis of the waveguide 1. In the present embodiment, eight cutout portions 4 are formed along the rim of the horn portion 1*a* at regular intervals of about 45°, and the depth of each cutout portion 4 is about one quarter of the wavelength λ0 of radio waves transmitted through the air. In FIG. 2, the horizontal direction is referred to as the x-axis and the vertical direction is referred to as the y-axis. A pair of cutout portions 4 positioned vertically are flush with the first probe 2 with respect to the direction of the y-axis, and a pair of cutout portions 4 disposed horizontally are flush with the second probe 3 with respect to the direction of the x-axis. Further, the cutout portions 4 are formed in the shape of a depressed groove along the wall surface from the open end of the horn portion 1*a*. Namely, projections and depressions are formed alternately along the rim of the opening end of the horn portion 1*a*.

Now, the operation of the so configured primary radiator will be described.

Figure 4:
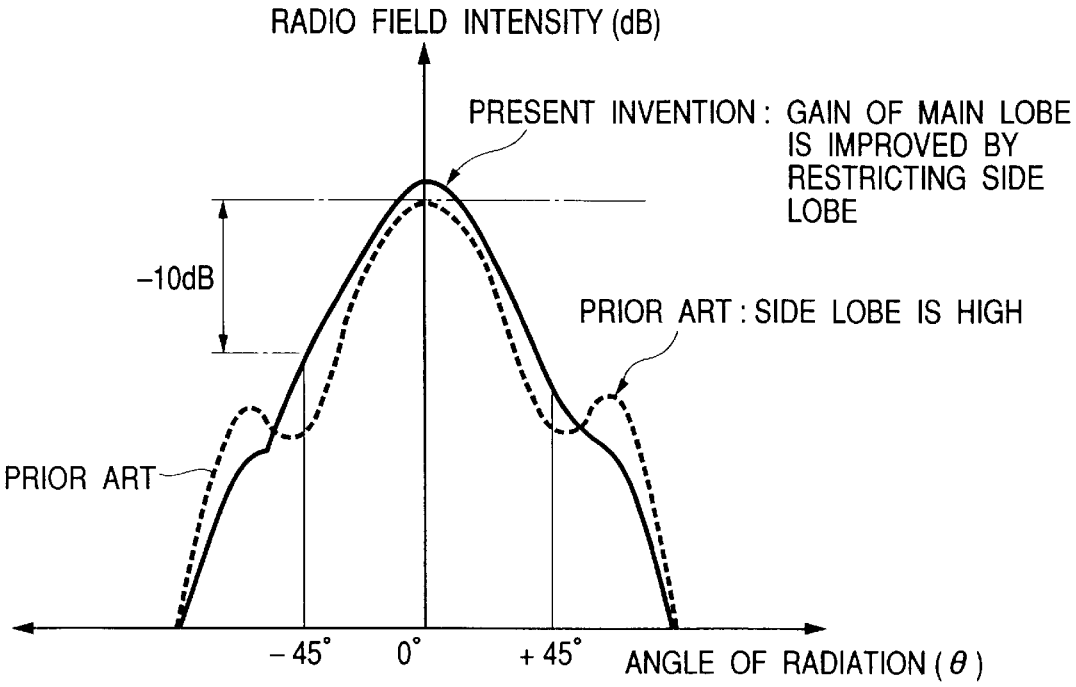
FIG. 4 PRIOR ART
FIG. 4 is an illustration showing a radiation pattern.

The linearly polarized waves transmitted from the satellite are collected by a reflector of an antenna, reach the primary radiator and enter the waveguide 1 through the horn portion 1*a*. Further, of the linearly polarized waves comprising a horizontally polarized wave and a vertically polarized wave inputted to the waveguide 1, the vertically polarized wave is joined to the first probe 2 and the horizontally polarized wave is joined to the second probe 4. Then, by frequency-converting received signals from the two probes 2, 3 into intermediate frequency signals by a converting circuit (not shown), the linearly polarized waves transmitted from the satellite can be received. Since a plurality of cutout portions 4 having depths of about λ0/4 wavelength is formed at the opening end of the horn portion 1*a*, the phase reversal of surface currents flowing through the cutout portions and the adjacent projecting portion (a portion without cutout portions 4) takes place, considerably reducing the side lobe. For instance, regarding the vertically polarized wave having a plane of polarization in the direction of the y-axis in FIG. 2, the side lobe can be reduced considerably by the operation of cutout portions 4 except the one on the x-axis (namely, by three pairs of cutout portions 4). Similarly, regarding the horizontally polarized waves having a plane of polarization in the direction of the x-axis in FIG. 2, the side lobe can be reduced considerably by the operation of the cutout portions 4 except the one on the y-axis (namely, by three pairs of cutout portions 4). Consequently, the shape of the radiation pattern becomes broad as shown by solid lines in FIG. 4. Thus, in accordance with the reduction of the side lobe, the gain of the main lobe can be decreased by 0.2 to 0.5 dB, making it possible to receive radio waves from the satellite efficiently.

Further, the primary radiator according to the present invention is not limited to the above embodiment and various modifications can be adopted. For example, the horn portion 1*a* may be in the shape of a pyramid instead of a cone, or the number of the cutout portions 4 may be increased or decreased as required.

The present invention is embodied as described above and has the following effects.

In a primary radiator having a horn portion for introducing radio waves at one end of a waveguide, a pair of cutout portions having a depth of about one quarter of the wavelength are provided at an opening end of the horn portion and such pair of cutout portions are disposed symmetrically with respect to an axis of the waveguide. Accordingly, the phase reversal of surface currents flowing through the cutout portions and an adjacent projecting portion takes place and a side lobe is considerably reduced, which in turn can increase the gain of a main lobe to achieve efficient reception of radio waves from a satellite.

What is claimed is:

1. A primary radiator comprising:

a waveguide having a horn portion that includes a funnel-shaped wall surface at one end for introducing radio waves; and a probe for receiving at least one component of polarization of radio waves entering the waveguide, wherein at least a pair of cutout portions having a depth of about one quarter of the wavelength of the radio waves are provided at an opening end of the horn portion along the funnel-shaped wall surface; and wherein the at least a pair of cutout portions is configured to reduce side lobes generated by surface current flowing at the funnel-shaped wall surface of the horn.

2. A primary radiator according to claim 1, wherein the at least a pair of cutout portions are disposed symmetrically with respect to an axis of the waveguide and are provided along a rim of the horn portion.

3. A primary radiator according to claim 2, wherein at least a pair of the cutout portions are disposed along the direction in which the probe extends.

4. A primary radiator according to claim 1, wherein at least a pair of the cutout portions are disposed along the direction in which the probe extends.

5. A primary radiator according to claim 1, wherein the waveguide further comprising another probe that extends in a direction orthogonal to said probe, the another probe for receiving polarization components that are orthogonal to said at least one polarization component, wherein said at least two cutout portions includes a cutout portion which is disposed to extend in a direction in which said probe extends, and another cutout portion which is disposed to extend in a direction in which the another probe extends.

6. A primary radiator comprising:

a waveguide having a horn portion at one end for introducing radio waves; and a first probe provided in said waveguide for receiving at least one polarization component of radio waves entering the waveguide, wherein at least two cutout portions are formed in the wall of said horn portion to extend from the open end edge of said horn portion over a depth which is about one quarter of the wavelength of the radio waves, said two cutout portions being sized so as to reduce side lobes caused by surface currents flowing along the surface of said horn portion through said probe.

7. A primary radiator according to claim 6, wherein said at least two cutout portions comprise pairs of cutout portions arranged along a rim of the horn portion, the cutout portions being symmetrically disposed about with respect to an axis of the waveguide.

8. A primary radiator according to claim 7, wherein said at least two cutout portions include a portion which is disposed in the direction in which the first probe extends.

9. A primary radiator according to claim 6, wherein said at least two cutout portions includes a cutout portion which is disposed in the direction in which the first probe extends.

10. A primary radiator according to claim 6, wherein the waveguide further includes a second probe that extends in a direction orthogonal to the first probe, the second probe for receiving polarization components that are orthogonal to said at least one polarization component, wherein said at least two cutout portions includes a cutout portion which is disposed to extend in a direction in which the first probe extends, and another cutout portion which is disposed to extend in a direction in which the second probe extends.

11. A primary radiator comprising:

a waveguide having a funnel-shaped horn portion at one end for introducing radio waves, the horn portion defined by an outer wall extending toward an opening end that terminates in a rim;

wherein the rim of the horn portion includes a plurality of projections and a plurality of depressions formed alternately along the rim at the opening end of the funnel-shaped horn portion such that the plurality of projections and depressions are formed by at least one pair of cutout portions in the outer wall and the at least one pair of cutout portions are disposed symmetrically with respect to an axis of the waveguide;

wherein the at least a pair of cutout portions is configured to reduce side lobes generated by surface current flowing at the funnel-shaped wall surface of the horn; and at least one probe for receiving at least one component of polarization of radio waves entering the waveguide.

12. A primary radiator according to claim 11, wherein the cutout portions of each pair of cutout portions are sized so that they have a depth of about one quarter of the wavelength of the radio waves.

13. A primary radiator according to claim 11, wherein the at least one probe comprises:

a first probe probe for receiving at least one component of polarization of radio waves entering the waveguide; and a second probe that extends in a direction orthogonal to the first probe, the second probe for receiving polarization components that are orthogonal to said at least one polarization component.

14. A primary radiator according to claim 13, wherein said at least two cutout portions includes a cutout portion which is disposed to extend in a direction in which the first probe extends, and another cutout portion which is disposed to extend in a direction in which the second probe extends.

15. A primary radiator comprising:

a waveguide having a horn portion at one end for introducing radio waves, the horn portion of the waveguide having a wall surface; and a first probe provided in said waveguide for receiving at least one polarization component of radio waves entering the waveguide, wherein at least two cutout portions are formed in the wall surface of said horn portion to extend from an open end edge of said horn portion over a depth which is about one quarter of the wavelength of the radio waves, said two cutout portions being configured to reduce a side lobe caused by surface current flowing at the surface of said horn portion through said probe.

16. A primary radiator according to claim 15, wherein the horn portion of the waveguide includes a funnel-shaped wall surface.

17. A primary radiator according to claim 15, wherein said at least two cutout portions comprise pairs of cutout portions arranged along a rim of the horn portion, the cutout portions being symmetrically disposed about the rim of the horn portion with respect to an axis of the waveguide.

18. A primary radiator according to claim 17, wherein said at least two cutout portions include a portion which is disposed in the direction in which the first probe extends.

19. A primary radiator according to claim 15, wherein said at least two cutout portions includes a cutout portion which is disposed in the direction in which the first probe extends.

20. A primary radiator according to claim 15, wherein the waveguide further includes a second probe that extends in a direction orthogonal to the first probe, the second probe for receiving polarization components that are orthogonal to said at least one polarization component, wherein said at least two cutout portions includes a cutout portion which is disposed to extend in a direction in which the first probe extends, and another cutout portion which is disposed to extend in a direction in which the second probe extends.

* * * * *